US006163013A

United States Patent [19]

King et al.

[11] Patent Number: 6,163,013

[45] Date of Patent: Dec. 19, 2000

[54] CONTINUOUS DUTY DIRECT CURRENT HEATED WINDSHIELD WITH AMBIENT TEMPERATURE LIMIT SWITCH

[75] Inventors: James H. King, Fort Wayne; Wayne F. Bultemeier, Hoaglund; James L. Roussey, Fort Wayne, all of Ind.

[73] Assignee: Navistar International Transportation Corp, Chicago, Ill.

[21] Appl. No.: 07/987,048

[22] Filed: Dec. 7, 1992

[51] Int. Cl.[7] ..... H05B 3/00

[52] U.S. Cl. ..... 219/203; 219/510; 52/171.2

[58] Field of Search ..... 219/203, 202, 219/219, 522, 506, 510; 52/171.2

[56] References Cited

U.S. PATENT DOCUMENTS

| | | | |
|---|---|---|---|
| 1,659,487 | 2/1928 | Hudson | 219/203 |
| 1,741,968 | 12/1929 | Beckmann | 219/203 |
| 3,524,044 | 8/1970 | Liardi | 219/203 |
| 3,982,092 | 9/1976 | Marriott | 219/203 |
| 4,277,672 | 7/1981 | Jones | 219/203 |
| 4,378,484 | 3/1983 | Kunert | 219/203 |
| 4,506,137 | 3/1985 | Meister | 219/203 |
| 4,603,451 | 8/1986 | VanSickle | 219/203 |
| 4,902,874 | 2/1990 | Tachimori et al. | 219/203 |
| 5,057,666 | 10/1991 | Takada | 219/203 |

FOREIGN PATENT DOCUMENTS

| | | | |
|---|---|---|---|
| 3513157 | 10/1986 | Germany . | |
| 57-70755 | 5/1982 | Japan | 219/203 |
| 58-76345 | 5/1983 | Japan | 219/203 |
| 2-37061 | 2/1990 | Japan | 219/203 |
| 2017465 | 10/1979 | United Kingdom | 219/203 |

*Primary Examiner*—John A. Jeffery

*Attorney, Agent, or Firm*—Dennis Kelly Sullivan; Jeffrey P. Calfa

[57] ABSTRACT

An electric heating grid extends from the middle of one side of the windshield, down that side to the bottom of the windshield, and from there across the bottom to the opposite side. The grid is operated by a control circuit having an on-off switch that is accessible to the vehicle operator. The control circuit includes a switch for sensing ambient outdoor temperature so as to allow the grid to be operated only when the outdoor temperature is below a threshold that distinguishes wintertime from non-wintertime conditions.

13 Claims, 2 Drawing Sheets

CONTINUOUS DUTY DIRECT CURRENT HEATED WINDSHIELD WITH AMBIENT TEMPERATURE LIMIT SWITCH

FIELD OF THE INVENTION

This invention relates generally to electrically heated window glass of automotive vehicles, and in particular to a new and unique means for electrically heating the windshield of an automotive vehicle.

BACKGROUND AND SUMMARY OF THE INVENTION

The use of an electric heating grid to heat automotive window glass is of course known. Such a grid is mounted on, or embedded in, the window glass, and is connected to a control circuit that controls the delivery of electric power to the grid. A typical control circuit comprises an on-off control switch and an associated timer or thermostatic control that is effective to eventually shut off the electric current flow in the grid at some time after the control switch has been turned on. Perhaps the most common application of an electric heating grid to automotive window glass is to the backlight of an automotive vehicle, although it is also known to electrically heat the windshield.

The purpose of heating automotive window glass is of course to defog or defrost the glass so that an occupant of the automotive vehicle can have better visibility through the glass. In the case of an automotive vehicle windshield, it is more typical to have a hot air defroster blow hot air across the inside of the windshield, rather than to employ an electrically heated grid on the windshield. However, each type of defrosting or defogging (i.e., hot air, electric heating) has its own advantages.

Electrical heating will generally result in faster defrosting or defogging, but it requires either an electric heating grid on the windshield or a special windshield containing a special heating element. It also requires that the vehicle's alternator have sufficient capacity to service both the windshield heating load and other electrical loads imposed by the vehicle.

A hot air defroster does not require as large an alternator as is required for an electrically heated windshield, but it does require a longer time to be effective since it derives thermal energy from the engine coolant, meaning that the engine must warm up before the hot air defroster becomes capable of delivering sufficient heat. A hot air defroster may also not be as capable as an electrically heated grid of delivering heat to a particular zone of the glass.

For certain automotive vehicles, a hot air defroster for the windshield may be entirely satisfactory. For other vehicles however the inclusion of electric heating may be desirable, either by itself to the exclusion of a hot air defroster, or else to at times supplement a hot air defroster.

The present invention relates to a new and unique control circuit for an electrically heated windshield which allows the windshield to be electrically heated only under conditions that are truly appropriate for electric heating.

For example, consider the case of a vehicle that is used in the snow. Snow may accumulate in some areas of the windshield which are less efficiently defrosted by the hot air defroster than others. Consequently, those less efficiently defrosted areas may experience a build-up of snow and/or ice that cannot be removed by the action of the hot air defroster alone. Therefore, it becomes desirable to provide those areas with an electric heating grid which is capable of melting snow/ice accumulation, hopefully before such an accumulation ever begins to become significant. However, since such conditions will occur only when the outside temperature is conducive to creating snow and/or ice, it may not be desirable to allow the electric heating to occur when such conditions are not present, and it is toward this objective that one of the several aspects of the present invention is directed.

According to this one aspect of the invention, a temperature sensing switch is associated with the control circuit for the electric heating grid such that the grid is allowed to operate only when the ambient temperature outside the passenger compartment of the vehicle is below a certain threshold. In a preferred embodiment of the invention this temperature sensing switch is disposed on the exterior of the vehicle to sense the outside temperature, and it is connected in a series circuit with an on-off control switch for the electric heating grid. The temperature sensing switch is open above a threshold temperature and closed below the threshold temperature so as to allow the on-off control switch to turn the heating grid on when the outside temperature is below the threshold, and to prevent the on-off control switch from turning the heating grid on when the outside temperature is above the threshold. The temperature sensing switch has a certain hysteresis in its switching characteristic such that it operates from open to closed at a nominal temperature that is below the nominal temperature at which it operates from closed to open. In the disclosed embodiment, the temperature sensing switch operates from open to closed at 40° F. nominal and from closed to open at 50° F. nominal. In this way, the invention allows the electric heating grid to be turned on during what is typically considered winter operation while disallowing the grid to be turned on during what is not considered as winter operation.

Another aspect of the invention relates to the disposition of the electric heating grid on the windshield. Specifically, the grid is disposed to extend from approximately the middle of one side of the windshield down that one side to the bottom of the windshield, and from there across the entire bottom of the windshield. In this way, the grid is for the most part out of the wiping pattern of the windshield wipers where it does not interfere with the view of the vehicle operator; yet it is positioned to be quite effective for melting snow/ice accumulation.

A still further aspect of the invention relates to the specific details of the control circuit. The electric heating grid is connected in series with normally open contacts of a relay whose coil is controlled both by the on-off control switch and by the temperature sensing switch such that the coil is energized to close the normally open relay contacts only when both the on-off control switch and the temperature sensing switch are closed.

The foregoing, as well as additional features, advantages, and benefits of the invention, will be seen in the ensuing description and claims which should be considered in conjunction with the accompanying drawings. The drawings disclose a presently preferred embodiment of the invention according to the best mode contemplated at this time for carrying out the invention.

DESCRIPTION OF THE PREFERRED EMBODIMENT

Figure 1:
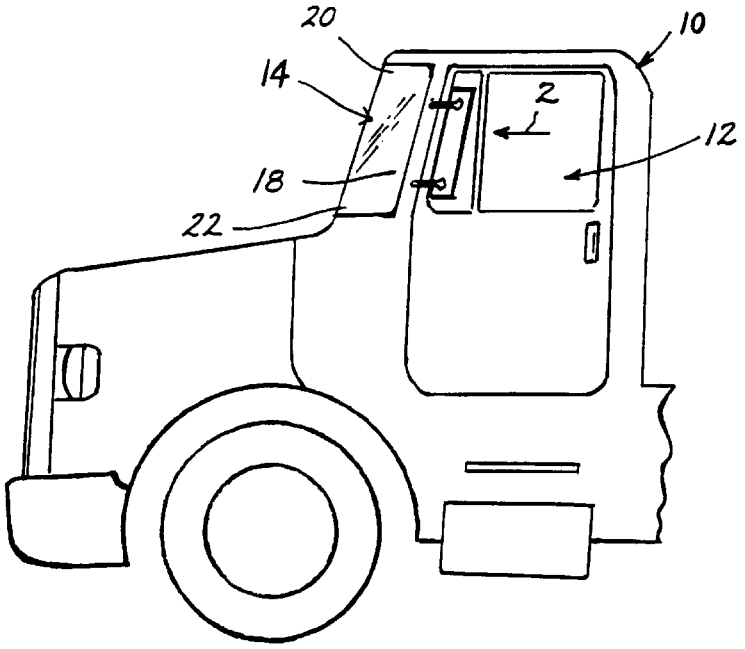
FIG. 1 is a left side elevational view of the front portion of a representative automotive vehicle, a heavy truck in particular, embodying principles of the invention.

FIG. 1 illustrates the front portion of a heavy truck 10 having the usual passenger compartment 12. The forward visibility for an occupant of the passenger compartment is provided by windshield glass 14 mounted by suitable glazing in a windshield opening of the truck cab body.

Figure 2:
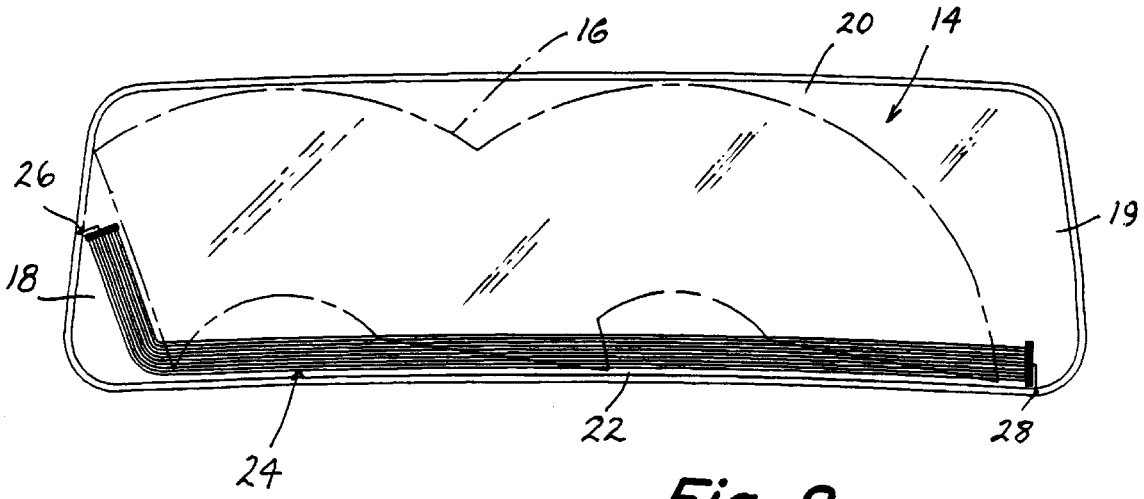
FIG. 2 is an enlarged view in the direction of arrow 2 in FIG. 1.

FIG. 2 is a view of windshield glass 14 looking outwardly from passenger compartment 12. The phantom lines in FIG. 2 depict the wiping pattern 16 of the truck's windshield wipers. Windshield glass 14 is generally rectangular in shape, although it is to be appreciated that it may wrap to a limited extent around the sides of the cab as shown in FIG. 1. The general rectangular shape of the window glass may be reasonably described as comprising vertical side margins 18 and 19, and top and bottom horizontal margins 20 and 22.

In accordance with principles of the invention, windshield glass 14 is provided with an electric heating grid 24. A preferred grid is a ceramic-based silvered material that is fired onto the window glass surface. The grid is considered to be permanent and highly resistant to damage. At opposite ends, grid 24 comprises electrical terminals 26 and 28 via which the grid electrically connects with a control circuit that will be subsequently described with reference to FIG. 3.

Terminal 26 is disposed in side margin 18 approximately halfway between top margin 20 and bottom margin 22. From there grid 24 extends down side margin 18 to bottom margin 22, and from there across bottom margin 22 to terminal 28 which is located at the junction of the other side margin 19 and bottom margin 22.

As can be seen from comparison of grid 24 with wiping pattern 16, grid 24 is for the most part disposed outside of the wiping pattern where it does not interfere with the road view of the vehicle operator, even though the grid may be quite imperceptible. Yet the grid is positioned to be quite effective for melting snow/ice accumulation that may occur along the lower margin of the windshield and the immediately contiguous left side margin of the windshield. Moreover, the heat may spread over a larger area of the glass.

Figure 3:
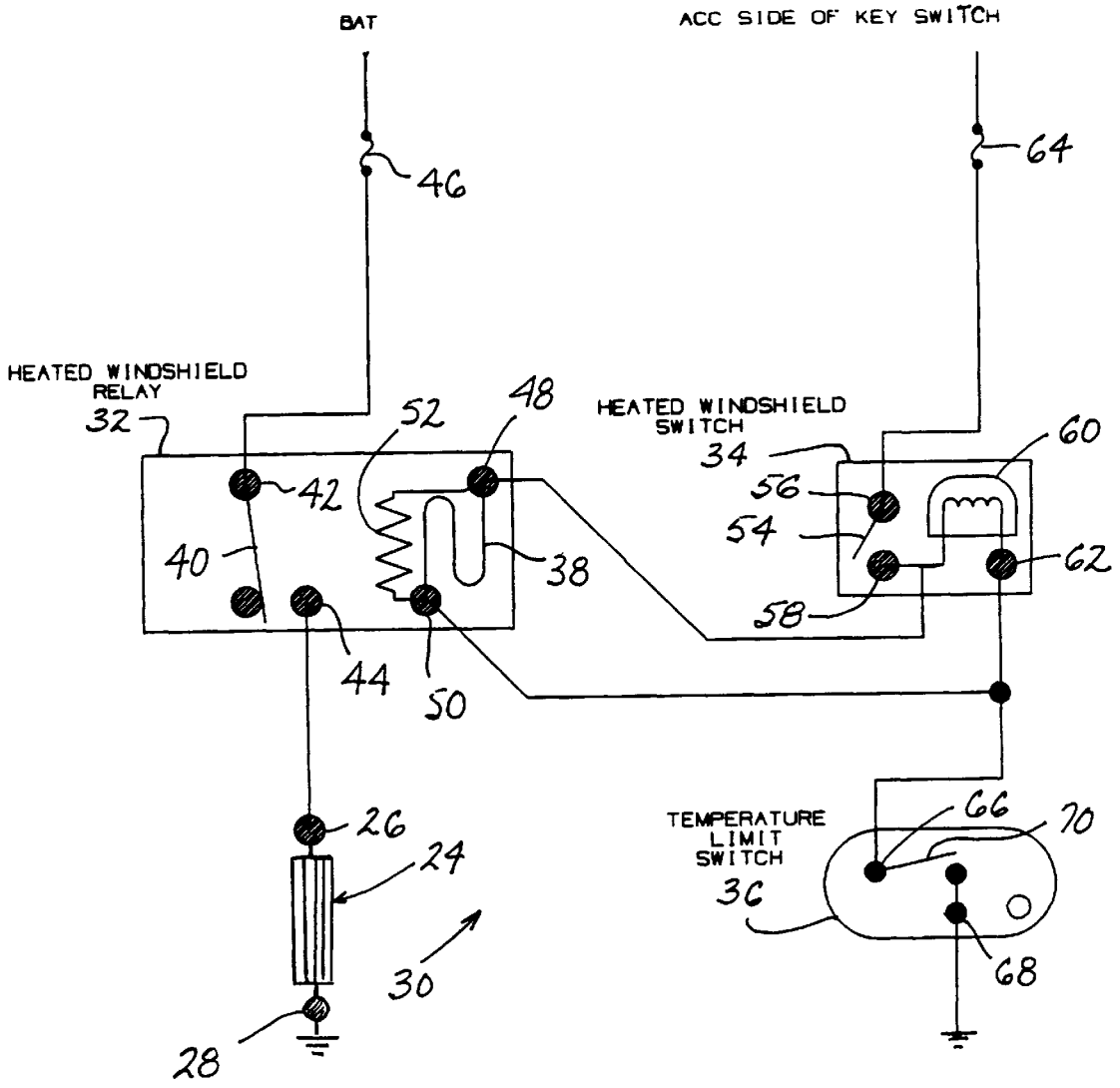
FIG. 3 is an electrical schematic diagram illustrating a preferred embodiment of the invention.

FIG. 3 illustrates a control circuit 30 that controls the delivery of electric power to electric heating grid 24. Control circuit 30 comprises a heated windshield relay 32, a heated windshield switch 34, and a temperature limit switch 36. Relay 32 comprises a coil 38 and normally open contacts 40 that are controlled by coil 38. Contacts 40 appear between a feed terminal 42 and a load terminal 44. Feed terminal 42 is connected through a circuit protection device 46 to the ungrounded side of the vehicle power supply, such power supply being a DC battery that is kept charged by means of a conventional engine driven charging system. In the drawing, the power supply is designated BAT. The opposite side of the power supply is connected to ground, which is designated in the drawing by the usual ground symbol. Coil 38 is connected between terminals 48 and 50 of relay 32. A resistor 52 shunts coil 38 for dissipating stored energy when the coil is de-energized. Terminal 26 of electric heating grid 24 is connected to terminal 44 of relay 32, while terminal 28 of grid 24 is connected to ground. Thus, the grid is connected across the power supply by the relay contacts.

Heated windshield switch 34 comprises a normally open switch element 54 which appears between terminals 56 and 58 of heated windshield switch 34. It also comprises an indicator lamp 60 that is connected between terminal 58 and a third terminal 62 of heated windshield switch 34. Terminal 56 is connected through a circuit protection device 64 to the accessory terminal of the usual key switch of truck 10. When the key switch is operated to a position that connects its accessory terminal to the ungrounded side of the vehicle power supply, the potential of that ungrounded side of the vehicle power supply is delivered through protection device 64 to terminal 56. When the key switch is in a position that does not connect the accessory terminal to that ungrounded side of the vehicle power supply, the potential of the ungrounded side of the power supply is not supplied to terminal 56.

Temperature limit switch 36 is a thermostatic switch that is mounted on the vehicle in a suitable location to sense temperature indicative of the temperature of the environment outside passenger compartment 12. Typically, switch 36 is mounted in a location on the exterior of the vehicle that will reliably sense ambient outside temperature. Switch 36 comprises terminals 66 and 68 between which a thermostatic switch element 70 is connected. The thermostatic switch element has a characteristic such that when it senses temperature above a certain threshold, it presents an open circuit between terminals 66 and 68 while it presents a closed circuit between these two terminals when it senses temperature below this threshold. Switch 36 has a certain hysteresis characteristic whereby this threshold spans a range of temperatures. Specifically, the preferred embodiment contemplates that the switch will operate from open to closed when the sensed temperature falls below a nominal temperature of 40° F., and that it will operate from closed to open when the sensed temperature rises above a nominal temperature of 50° F. A certain tolerance is also associated with each of these limit, for example plus or minus 5° F. about each limit. Such tolerances are typically present in the mass production of this type of switch.

Circuit 30 comprises means operatively connecting switches 34 and 36 with relay 32 such that terminal 58 is connected to terminal 48 and terminals 50, 62, and 66 are connected in common. As a result, coil 38 is connected in a series circuit with switch element 54 of heated windshield switch 34 and switch element 70 of temperature limit switch 36 across the vehicle power supply. In particular, coil 38 is connected between heated windshield switch 34 and temperature limit switch 36.

Circuit 30 operates in the following manner. As long as coil 38 remains de-energized, contacts 40 remain open, and electric heating grid 24 cannot be energized. When coil 38 is energized, contacts 40 operate closed to connect electric heating grid 24 with the vehicle power supply. Consequently, electric power is delivered through heated windshield relay 32 to heating grid 24, thereby heating windshield 14.

Coil 38 can be energized however only for certain operating conditions of heated windshield switch 34 and temperature limit switch 36. Specifically, coil 38 can be energized only upon concurrence of both heated windshield switch 34 and temperature limit switch 36 being closed. When both switches are closed, current is conducted through switch element 54, coil 38, and temperature limit switch 36. At the same time, current can flow through indicator lamp 60 because it is in effect in parallel with coil 38. Thus, indicator lamp 60 serves to indicate when electric heating grid 24 is being energized.

Because of the control which is afforded by temperature limit switch 36, electric heating grid 24 is allowed to be energized only when ambient outside temperature is below the established threshold. When the outside temperature is above that threshold, it is not possible to energize the grid. In this way, it is assured that operation of the grid will be allowed only under conditions that are indicative of winter-like operation, and they of course are the times when the use of the heating grid may be important. By the same token, temperature limit switch 36 assures that the heating grid will not be operated during times of higher ambient outside temperature when an additional thermal energy input to the windshield via a heating grid may be inappropriate.

The provision of temperature limit switch 36 allows for a rather substantial thermal energy input to the windshield during times when ambient outside temperature is low, yet it avoids introducing such large thermal energy inputs under ambient conditions that do not call for them.

By way of example, the preferred embodiment contemplates a grid that draws approximately 21 amperes of electric DC current from a nominal 12 volt DC battery when first energized, and that draws approximately 17 amperes after warm-up. This will provide an effective thermal energy input for keeping snow and ice accumulations from the windshield.

A test conducted when outside ambient temperature was approximately 35° F. and the existing hot air defroster was off, showed that temperature on the inside of the windshield on the driver's side of the vehicle measured a maximum of 123° F. after 35–40 minutes of operation while the outside temperature of the windshield measured a maximum of 70° F. to 75° F. When the hot air defroster was operated at maximum temperature and maximum speed, the maximum inside windshield temperature fell to 109° F. while the maximum outside temperature fell to 63° F. to 68° F. The engine coolant temperature that was provided to the hot air defroster registered approximately 120° F. to 130° F. on the water temperature gauge of the vehicle. Given this data, it can be seen that the heated windshield of the present invention can be left on continuously during cold weather operation, as allowed by temperature sensitive switch 36, without adversely affecting the windshield glass.

On the basis of the foregoing then, it can be seen that the invention provides a meaningful improvement for winter-time defrosting of the windshield of an automotive vehicle. While a presently preferred embodiment of the invention has been illustrated and described, it should be appreciated that principles of the invention may be embodied in other equivalent ways falling within the scope of the following claims.

What is claimed is:

1. An automotive vehicle having a passenger compartment with window glass that separates the inside of the passenger compartment from the outside environment, an electric heating element disposed on said window glass for heating the same by means of electric power, an electric power source for providing electric power, and a control circuit for controlling the delivery of electric power from said electric power source to said electric heating element, characterized in that said control circuit comprises selectively operable conducting means connected between said electric power source and said electric heating element, and means for operating said selectively operable conducting means comprising an on-off switch means that is accessible to an operator of the vehicle, a temperature sensing switch means that is disposed in non-thermal sensing relationship to said electric heating element to reliably sense temperature indicative of the ambient temperature of the outside environment, and means operatively relating said on-off switch means and said temperature sensing switch means with said selectively operable conducting means for allowing electric power to be delivered from said electric power source through said selectively operable conducting means to said electric heating element responsive to said on-off switch means being on and said temperature sensing switch means indicating that the ambient temperature of the outside environment is below a certain threshold and for disallowing electric power to be delivered from said electric power source through said selectively operable conducting means to said electric heating element either responsive to said on-off switch means being off or said temperature sensing switch means indicating that the ambient temperature of the outside environment is above said threshold, characterized further in that said selectively operable conducting means is a relay having a coil and normally open contacts that are operated by said coil, said means operatively relating said on-off switch means and said temperature sensing switch means with said selectively operable conducting means comprises means connecting said coil in series with said on-off switch means and said temperature sensing switch means, and said contacts are connected between said electric power source and said electric heating element.

2. An automotive vehicle as set forth in claim 1 characterized further in that said window glass comprises a windshield of the vehicle.

3. An automotive vehicle as set forth in claim 2 characterized further in that said windshield is generally rectangular in shape, comprising vertical side margins and horizontal top and bottom margins, and in that said electric heating element is a grid that has one termination at one of said side margins spaced between said top and bottom margins and another termination at a junction of the other of said side margins and said bottom margin, and that extends from said one termination down said one side margin to a junction of said one side margin and said bottom margin, and from said last-mentioned junction across said bottom margin to said other termination.

4. An automotive vehicle as set forth in claim 3 characterized further in that said one termination is spaced approximately halfway between said top and bottom margins.

5. An automotive vehicle as set forth in claim 1 characterized further in that an indicator lamp is associated with said on-off switch means to illuminate when said electric power source is delivering electric power to said electric heating element, and said indicator lamp is connected in parallel with said coil.

6. An automotive vehicle as set forth in claim 1 characterized further in that said temperature sensing switch means is disposed on the vehicle exteriorly of the passenger compartment to directly sense temperature of the outside environment.

7. An automotive vehicle as set forth in claim 6 characterized further in that said temperature sensing switch means comprises a thermostatic switch that operates from open to closed at one nominal limit of said threshold and from closed to open at another nominal limit of said threshold.

8. An automotive vehicle as set forth in claim 7 characterized further in that said one nominal limit of said threshold is approximately 40° F. and said another nominal limit of said threshold is approximately 50° F.

9. An automotive vehicle having a passenger compartment with window glass that separates the inside of the passenger compartment from the outside environment, an electric heating element disposed on said window glass for heating the same by means of electric power, an electric power source for providing electric power, and a control circuit for controlling the delivery of electric power from said electric power source to said electric heating element, characterized in that said control circuit comprises selectively operable conducting means connected between said electric power source and said electric heating element, and means for operating said selectively operable conducting means comprising an on-off switch means that is accessible to an operator of the vehicle, a temperature sensing switch means that is disposed to sense temperature indicative of the temperature of the outside environment, and means operatively relating said on-off switch means and said temperature sensing switch means with said selectively operable conducting means for allowing electric power to be delivered from said electric power source through said selectively operable conducting means to said electric heating element responsive to said on-off switch means being on and said temperature sensing switch means indicating that the temperature of the outside environment is below a certain threshold and for disallowing electric power to be delivered from said electric power source through said selectively operable conducting means to said electric heating element either responsive to said on-off switch means being off or said temperature sensing switch means indicating that the temperature of the outside environment is above said threshold, and wherein said selectively operable conducting means is a relay having a coil and normally open contacts that are operated by said coil, said means operatively relating said on-off switch means and said temperature sensing switch means with said selectively operable conducting means comprises means connecting said coil in series with said on-off switch means and said temperature sensing switch means, and said contacts are connected between said electric power source and said electric heating element, characterized further in that said means connecting said coil in series with said on-off switch means and said temperature sensing switch means comprises means connecting said coil in circuit between said on-off switch means and said temperature sensing switch means.

10. An automotive vehicle as set forth in claim 9 characterized further in that an indicator lamp is associated with said on-off switch means to illuminate when said electric power source is delivering electric power to said electric heating element, and said indicator lamp is connected in parallel with said coil.

11. An automotive vehicle having a passenger compartment with window glass that separates the inside of the passenger compartment from the outside environment, an electric heating element disposed on said window glass for heating the same by means of electric power, an electric power source for providing electric power, and a control circuit for controlling the delivery of electric power from said electric power source to said electric heating element, characterized in that said control circuit comprises temperature sensing means disposed in non-thermal sensing relationship to said electric heating element for reliably sensing ambient temperature of the outside environment and means connecting said temperature sensing means in said control circuit for allowing electric power to be delivered from said electric power source to said electric heating element responsive to said temperature sensing means sensing that the ambient temperature of the outside environment is below a certain threshold and for disallowing electric power to be delivered from said electric power source to said electric beating element responsive to said temperature sensing means sensing that the ambient temperature of the outside environment is above said threshold characterized further in that said threshold is a range having a lower limit at approximately 40° F. and an upper limit at approximately 50° F.

12. An automotive vehicle as set forth in claim 11 characterized further in that said window glass is generally rectangular in shape, comprising vertical side margins and horizontal top and bottom margins, and in that said electric heating element is a grid that has one termination at one of said side margins spaced between said top and bottom margins and another termination at a junction of the other of said side margins and said bottom margin, and that extends from said one termination down said one side margin to a junction of said one side margin and said bottom margin, and from said last-mentioned junction across said bottom margin to said another termination.

13. An automotive vehicle as set forth in claim 12 in which said window glass comprises a windshield of the vehicle.

* * * * *